US006092887A

United States Patent [19]

Tanino et al.

[11] Patent Number: 6,092,887

[45] **Date of Patent: *Jul. 25, 2000**

[54] INK-JET PRINTER

[75] Inventors: Ken Tanino, Kobe; Yoshinori Tanaka, Sakai, both of Japan

[73] Assignee: Minolta Co., Ltd., Osaka, Japan

[ * ] Notice: This patent is subject to a terminal disclaimer.

[21] Appl. No.: 08/903,221

[22] Filed: Jul. 22, 1997

[30] Foreign Application Priority Data

Jul. 22, 1996 [JP] Japan ..... 8-191991
Sep. 11, 1996 [JP] Japan ..... 8-240351

[51] Int. Cl.[7] ..... B41J 23/00
[52] U.S. Cl. ..... 347/37; 347/40
[58] Field of Search ..... 347/37, 15, 40, 347/43, 100

[56] References Cited

U.S. PATENT DOCUMENTS

| | | | |
|---|---|---|---|
| 4,728,968 | 3/1988 | Hillmann et al. | 347/43 |
| 5,208,605 | 5/1993 | Drake | 347/15 |
| 5,412,410 | 5/1995 | Rezanka | 347/15 |
| 5,771,050 | 6/1998 | Gielen | 347/19 |
| 5,963,230 | 10/1999 | Higashino et al. | 347/40 |

FOREIGN PATENT DOCUMENTS

| | | | |
|---|---|---|---|
| 0031421A2 | 7/1981 | European Pat. Off. | 347/40 |
| 0 444 863 | 9/1991 | European Pat. Off. | 347/15 |
| 0 636 482 | 2/1995 | European Pat. Off. | 347/15 |
| 58-12764 | 1/1983 | Japan | 347/43 |
| 406255132 | 9/1994 | Japan | 347/15 |

*Primary Examiner*—N. Le
*Assistant Examiner*—Shih-Wen Hsieh
*Attorney, Agent, or Firm*—Sidley & Austin

[57] ABSTRACT

An ink-jet printer of the invention comprises a print head having nozzles for ejecting an ink material therefrom, a carriage supporting the print head, and a adjust mechanism adjusting a relative position between the print head and the carriage. According to the invention, the relative position of nozzles with respect to the carriage can be adjusted by the adjust mechanism after the print head has been attached to the carriage. Therefore, great precision is not required when attaching the print head to the carriage, simplifying its assembling.

11 Claims, 6 Drawing Sheets

SCANNING DIRECTION 57
PERPENDICULAR DIRECTION 58
2
6
10
9
11
12
8
15
16
17
18
65
4
4Bk
4Y
171y
3M
3C
171c
3
5
7

INK-JET PRINTER

FIELD OF THE INVENTION

The invention relates to an ink-jet printer for recording an image by ejecting ink droplets through nozzles in response to image signals and then depositing the same on a recording medium such as paper.

BACKGROUND OF THE INVENTION

Conventionally, there has been known an ink-jet recording device which includes an ink-jet head having a plurality of nozzles for ejecting droplets of ink material.

Also, another ink-jet recording device for color printing has been used in which a plurality of ink-jet heads have ink materials of different colors, respectively. The ink-jet heads are supported on a carriage which moves transversely on a recording medium such as plain paper. With this color ink-jet recording device, the plurality of color ink materials are ejected from respective heads with the movement of the carriage, thereby forming a color image on the recording medium.

To form a high quality color image on the recording medium using such an ink-jet color recording device, each ink droplet ejected from the nozzles must be deposited in positions on the recording medium for reproducing the original colors thereon. For this purpose, the nozzles should be formed in respective positions in each head. Further, the heads should be mounted in positions with great precision on the carriage while maintaining a precise positional relationship of the plurality of heads. Furthermore, when the plurality of heads are mounted on the carriage through a common plate, the common plate should be secured in position on the carriage by the use of a suitable tool. As a result, the assembling of the ink-jet recording head presents significant difficulties.

In addition, the carriage is typically designed to travel along a guide rod extending in the transverse direction of the recording medium. With this arrangement, the carriage may slightly incline with respect to the guide rod due to a variation of the frictional force to be possibly generated between the guide rod and the carriage, which may result in an unwanted positional displacement of the deposited ink droplets on the recording medium. This may also happen due to a wearing of the contact portions of the carriage and the guide rod.

Another ink-jet recording head that is known in the art has a plurality of nozzles for ejecting ink droplets of different sizes to form respective ink dots having different diameters on the recording medium, thereby reproducing a halftone image by the combination of large and small ink dots.

With this ink-jet head, by using three or four ink materials having different colors, respectively, a variety of colors can be reproduced on the recording medium by depositing two ink dots having different sizes and colors on the same place or by depositing the ink dots on different places in a small area and thereby visually mixing different colors. It is to be noted that the former color mixing method is more advantageous than the latter one for reproducing halftone colors.

One method for ejecting different sizes of ink droplets is accomplished by providing the ink-jet recording head with nozzles of different sizes. For example, U.S. Pat. No. 5,208,605 discloses an ink-jet recording head which includes a plurality of small nozzles arranged on a first line and a plurality of large nozzles arranged on a second line parallel to the first one. Also, U.S. Pat. No. 5,412,410 discloses another ink-jet recording head in which the large and small nozzles are arranged alternately on a line extending in a direction along which the recording medium is forwarded.

However, each of the ink-jet recording heads disclosed has drawbacks. For example, when superimposing the small ink dot on the large ink dot, the second ink dot can be deposited on the first ink dot which has not been dried yet, which eventually results in an unwanted color mixing and therefore it is impossible to reproduce an intended color. In particular, in color reproduction, the mixing of color is a critical problem which will significantly degrade the quality of the reproduced image.

SUMMARY OF THE INVENTION

Among the several objects and features of the invention may be noted the provision of an improved ink-jet printer.

An ink-jet printer of the invention comprises a print head having nozzles for ejecting an ink material therefrom, a carriage supporting the print head, and an adjust mechanism adjusting a relative position between the print head and carriage.

According to the invention, the relative position of nozzles with respect to the carriage can be adjusted by the adjust mechanism after the print head has been attached to the carriage. Therefore, great precision is not required in the attachment of the print head to the carriage, thereby allowing an assembling of the print head to be simplified.

Also, the relative positions of the nozzles in the print head with respect to the carriage can be adjusted by the adjust mechanism to eliminate the tilt of the nozzle corresponding to the tilt of the carriage with respect to the guide shaft. As a result, the displacement of the position at which an ink droplet is deposited on the recording medium can be adjusted. Therefore, according to the invention, the displacement of the deposited position of the ink droplet can be suitably adjusted depending upon the tilt of the nozzle in a practical use of the printer, allowing a quality of a reproduced image to be maintained.

In another aspect of the invention, the ink-jet printer having a print head which moves in a first direction as it ejects ink droplets through a plurality of nozzles opposing to a recording medium to reproduce an image on the recording medium comprises a first nozzle group which consists of a plurality of first nozzles arranged in a second direction perpendicular to the first direction. The ink-jet printer also comprises a second nozzle group which consists of a plurality of second nozzles arranged in the second direction. Each of the second nozzles ejects an ink droplet larger than that ejected through the first nozzle of the first nozzle group. The first and second nozzle groups are arranged adjacent to each other with respect to the second direction.

The first and second nozzle groups may be arranged on the same line extending in the second direction or may be shifted from each other with respect to the first direction.

With this ink-jet printer, to reproduce various colors, for example, a small ink droplet ejected from the first nozzle group is superimposed on a large ink dot formed by a large ink droplet ejected from the second nozzle group at the same position on the recording medium. In this case, the time difference between the depositions of the large and small ink droplets is equal to a time in which the recording medium moves in the second direction by a distance between the second nozzle ejecting the large ink droplet and the nozzle ejecting the small ink droplet. The time difference is enough to completely dry the large ink dot deposited previously on the recording medium.

Therefore, when the small ink droplet is deposited on the large ink dot, a mixture of colors of the two ink droplets can be prevented. As a result, for example, when a multi-color image is reproduced by the inkjet printer having a plurality of the print heads arranged in the first direction to eject ink droplets having respective colors from the print heads, a high quality colorful image can be reproduced without damaging the color of the respective ink dot.

Also, even when a color reproduction is performed by depositing large and small ink droplets of different colors adjacent to each other on the recording medium, like effects can be obtained.

Specifically, when the second ink droplet is deposited adjacent to the first ink dot which has not dried yet, two ink material having different colors may be connected and then mixed, resulting in a mixture of colors. According to the ink-jet printer having such nozzles arrangement of the invention, however, the ink dots can be formed on the recording medium independently by the ink droplets because the previously deposited ink dot is completely dried before the subsequent ink droplet is deposited, and thereby a high quality colorful image can also be reproduced by this method of color reproduction.

BRIEF DESCRIPTION OF THE INVENTION

The present invention will be described with reference to the accompanying drawings wherein like reference numerals refer to like parts in the several views, and wherein.

PREFERRED EMBODIMENT OF THE INVENTION

Figure 1:
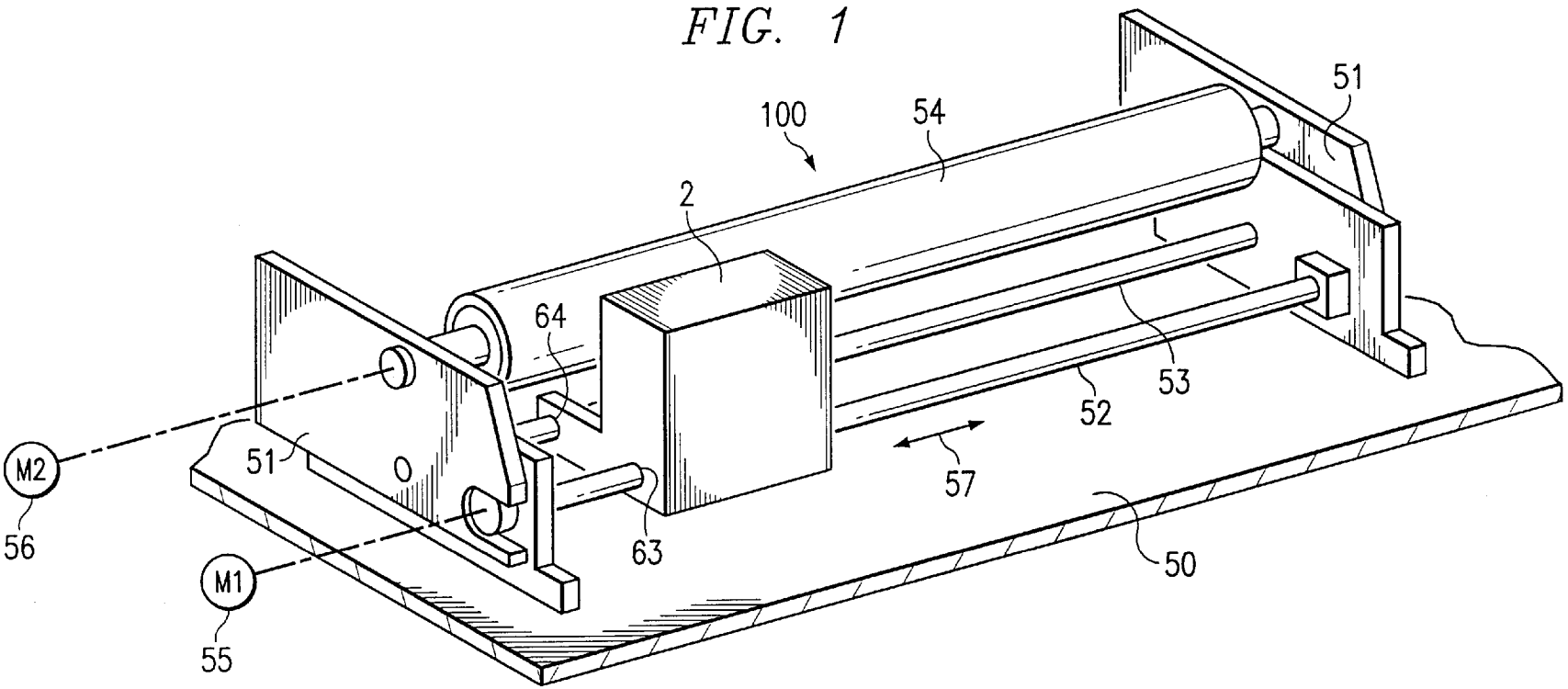
FIG. 1 is a perspective view of a printing station of an ink-jet printer according to the invention.

With reference to the drawings, and more particularly FIG. 1, there is shown a printing station of an ink-jet printer for color printing, generally indicated by reference numeral 100, according to the invention. The ink-jet printer 100 includes a base 50. A pair of side walls 51 are provided on the base 50 with a sufficient space therebetween. A screw rod 52, guide rod 53 and back-up roll 54 are supported in parallel with each other by the side walls 51. The screw rod 52 and back-up roll 54 are drivingly connected to motors 55 and 56, respectively.

A carriage 2 has a threaded hole 63 and a through hole 64 in which the screw rod 52 and guide rod 53 are inserted, respectively, so that, by the rotation of screw rod 52, it can move at a constant speed along the screw rod 52 and guide rod 53 in a first direction (i.e., scanning direction) indicated by an arrow 57.

Figure 2:
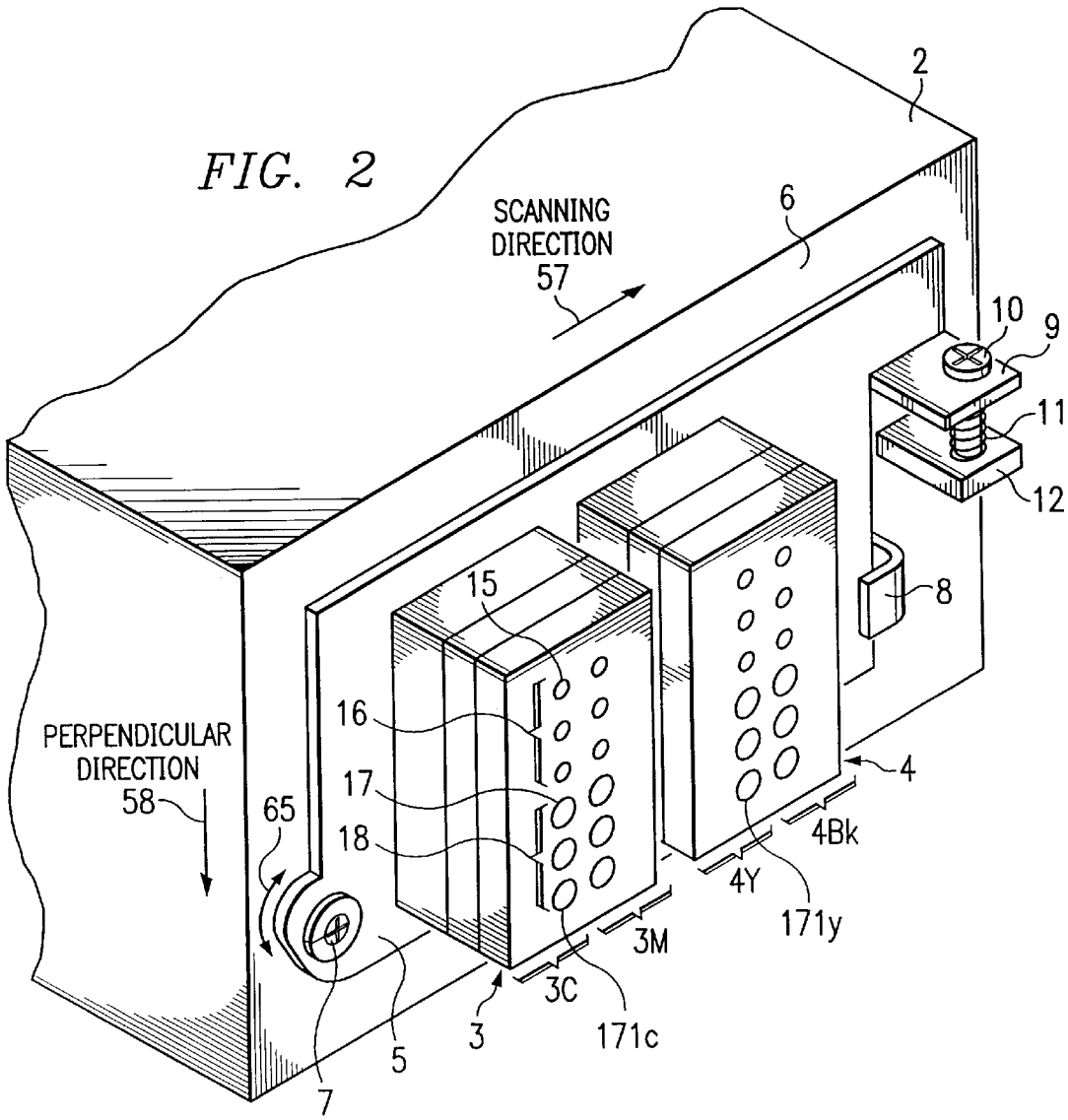
FIG. 2 is a perspective view showing a portion opposing to a recording medium of the carriage of the ink-jet printer in FIG. 1.

As shown in FIG. 2, the carriage 2 carries ink-jet print heads 3 and 4 on a surface 6 opposing to the back-up roll 54. The print heads 3 and 4 eject ink droplets towards a recording medium (not shown), such as plain paper, supported by an outer peripheral surface of the back-up roll 54 to reproduce an image on the recording medium.

An adjust mechanism for adjusting a relative position of the print heads 3 and 4 with respect to the carriage 2 comprises a support plate 5. The support plate 5 for supporting the print heads 3 and 4 is mounted on the surface 6 of the carriage 2 by a screw, or pivot 7 extending in a direction perpendicular to the scanning direction 57 and thereby rotating about the screw 7 in a direction of an arrow 65. To keep the support plate 5 in close contact with the surface 6 of the carriage 2, the carriage 2 has a portion 8 capable of engaging with a top surface of the support plate 5.

The support plate 5 has a portion 9 extending perpendicularly from the support plate 5 and having a through hole (not shown). Also, mounted on the surface 6 of the carriage 2 is a projection 12 having a threaded hole into which an adjust screw 10 inserted in the through hole of the portion 9 is engaged. A spring 11 is mounted around the adjust screw 10 between the portion 9 and the projection 12, thereby forcing the portion 9 in a direction away from the projection 12. With this arrangement, by rotating the adjust screw 10, the support plate 5 can be rotated about the screw 7 so that an adjustment of relative positions of the print heads 3 and 4 with respect to the carriage 2 can be achieved. The adjust mechanism is not limited to this embodiment, various mechanisms capable of adjusting a relative position of the support plate 5 with respect to the carriage 2 may be adopted.

Figure 3:
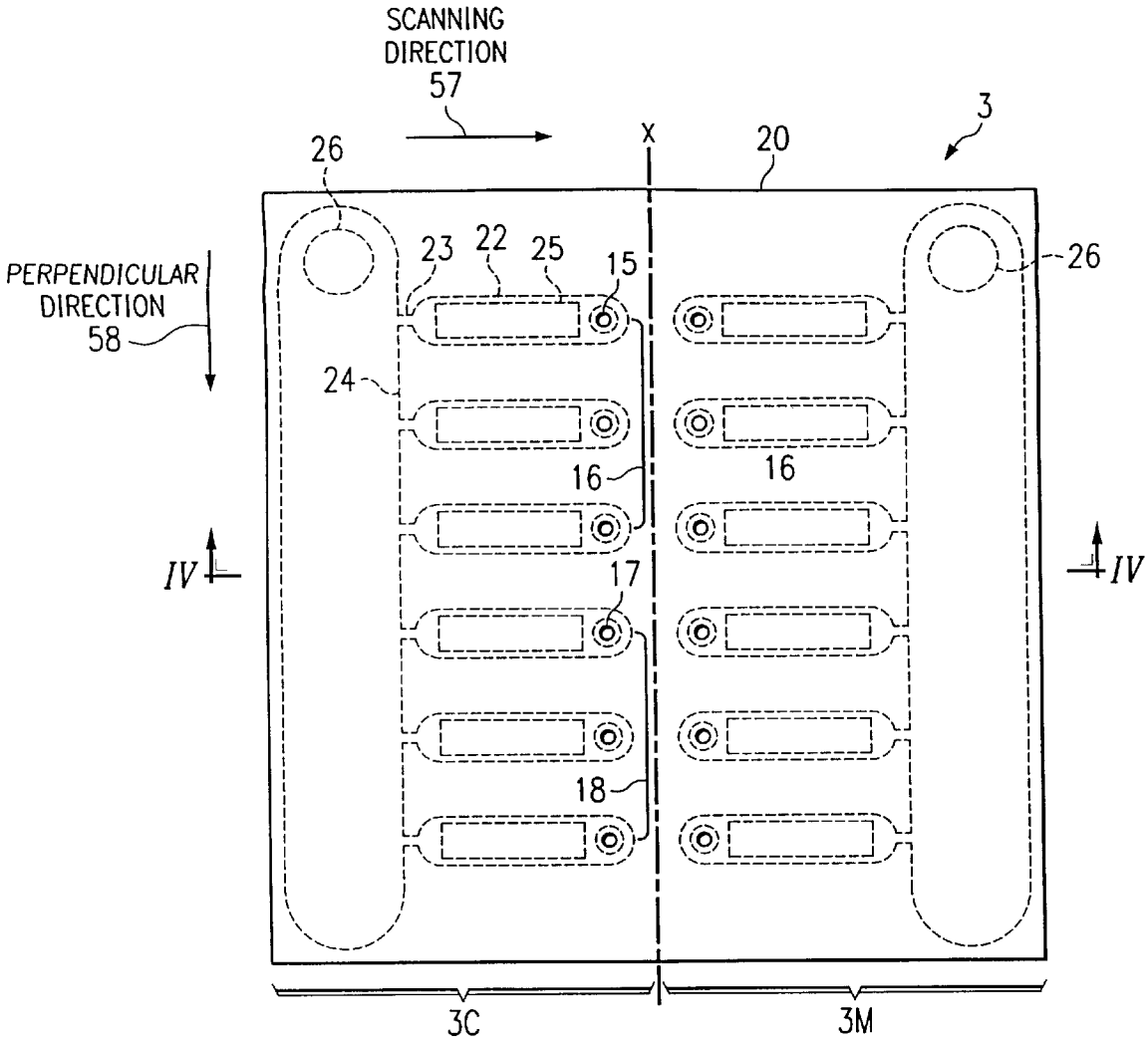
FIG. 3 is a front view of the print heads provided to the carriage in FIG. 2.

The print heads 3 and 4 are aligned in the scanning direction 57 on the support plate 5. Each of the print heads 3 and 4 has two head portions for ink materials having different colors, respectively. Specifically, as best shown in FIG. 3, the print head 3 integrally includes a first head portion 3C for cyan ink material and a second head portion 3M for magenta ink material, arranged symmetrically with respect to a central imaginary line X. Similar to the print head 3, the print head 4 also integrally includes a third head portion 4Y for yellow ink material and a fourth head portion 4Bk for black ink material. Since the print head 4 has the same structure as the print head 3, a structure of the head print head 3 will be only described hereinafter.

Figure 4:
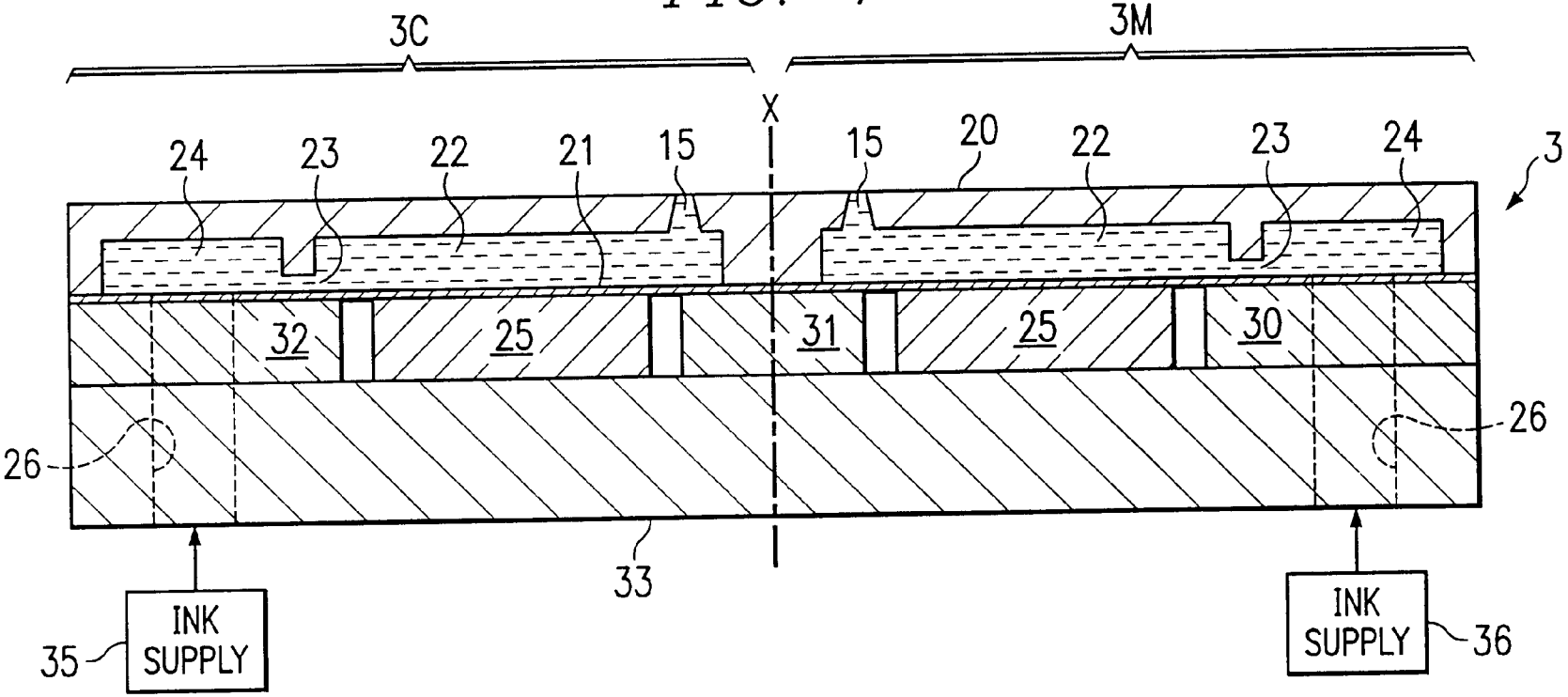
FIG. 4 is a cross sectional side elevation view of the print head taken along the line IV—IV in FIG. 3.

Referring to FIGS. 3 and 4, the print head 3 comprises a channel plate 20 on a portion opposing to the recording medium. A back surface (i.e., lower surface in FIG. 4) of the channel plate 20, which is a planar plate made of metal or resin, includes a plurality of concave portions, preferably formed by etching, lithography, or photolithography. A diaphragm 21, which is a thin film made of metal or resin, is bonded on the back surface of the channel plate 20 to cover the concave portions, and thereby form a plurality of elongated ink channels 22, ink inlets 23 and ink supply chambers 24, for the first and second head portions 3C and 3M, respectively.

The ink channels 22 are extended along the scanning direction 57 and spaced a certain distance away from each other with respect to a second direction (i.e., perpendicular direction 58) perpendicular to the scanning direction 57. The ink supply chamber 24 receiving the ink material is fluidly communicated with the ink channels 22 so that the ink material can be supplied from the ink supply chamber 24 to the respective ink channels 22 through associated ink inlets 23.

The channel plate 20 also has a plurality of first nozzles 15 and second nozzles 17 in the first and second head portions 3C and 3M, respectively, for ejecting cyan and magenta ink materials, respectively. In this embodiment, the first nozzle 15 has a smaller diameter than the second nozzle 17 so that the nozzle 17 can eject ink droplets larger than those ejected from the nozzle 15, and therefore the first and second nozzles 15 and 17 will be referred to as small-diameter nozzle 15 and large-diameter nozzle 17 hereinafter.

The small-diameter nozzles 15 are arranged in a line and provided a small-diameter nozzle array 16, while the large-diameter nozzles 17 are arranged in a line and provided a large-diameter nozzle array 18. Also, the small-diameter nozzle array 16, i.e., a first nozzle group, and the large-diameter nozzle array 18, i.e., a second nozzle group, are arranged adjacent to each other along an imaginary line (not shown) extending in the perpendicular direction 58.

Although, in this embodiment, the nozzles 15 and 17 are arranged in a line, the nozzles 15 may be shifted a certain distance from the nozzle 17 with respect to the scanning direction 57. Also, the nozzles 15 and 17 may be shifted alternately in the scanning direction 57.

Further, although diameters of the nozzles 15 and 17 are different from each other to eject small and large ink droplets, various means can be adopted to eject small and large ink droplets. For example, sizes of ink droplets may be varied by forming the nozzle 15 and 17 having the same sizes and changing voltages applied to piezoelectric members which will be described below.

Referring still to FIG. 4, spacers 30, 31 and 32 are fixed under the diaphragm 21 and further a base plate 33 made of a rigid material such as ceramic is secured under the spacers 30, 31 and 32. A plurality of elongated piezoelectric members 25, preferably made of piezoelectric materials, such as, lead zirconate and lead titanate, are fixed between the diaphragm 21 and base plate 33. The piezoelectric members 25 are arranged to oppose the ink channels 22 through the diaphragm 21 and extended along the ink channels 22, respectively. The piezoelectric member 25 is capable of deforming when a voltage is applied thereto, thereby pressurizing the ink material in adjacent ink channel 22 through the diaphragm 21 to eject ink droplets through corresponding nozzle 15 or 17.

For this purpose, the piezoelectric member 25 is in the form of a rectangular body having electrodes (not shown) on upper and lower surfaces thereof and is configured that it has a length and a width slightly smaller than those of the ink channel 22. Also, the piezoelectric member 25 is polarized so that it can deform by the application of a voltage between the upper and lower electrodes. Further, the upper electrode of piezoelectric member 25 is electrically connected to the ground through the diaphragm 21 made of an electrically conductive material, while the lower electrode of piezoelectric member 25 is electrically connected to a driver not shown through a lead wire patterned on the base plate 33 in correspondence thereto so that a voltage can be applied to each piezoelectric member 25 in response to an image signal from the driver. The electrical connection of the electrodes described above is not limited thereto, and it may be modified in different ways.

In the print head 3, the cyan and magenta ink materials are supplied to the ink supply chambers 24 of the first and second head portions 3C and 3M through ink supply ports 26 from ink supplies 35 and 36, respectively. Each ink material in the ink supply chamber 24 is then distributed to the ink channels 22 via associated ink inlets 23. Likewise, yellow and black ink materials are supplied to the ink channels 22 of the third and fourth head portions 4Y and 4Bk in the print head 4, respectively.

An operation for adjusting the depositing positions of ink droplets prior to the color printing by the ink-jet printer 100 so constructed will be described hereinafter.

Initially, the support plate 5 supporting the print heads 3 and 4 is positioned at a predetermined position which makes sure that the nozzles 15 and 17 of the head portions 3C, 3M, 4Y and 4Bk at each level with respect to the direction 58 are located on one line in the scanning direction 57.

To confirm whether the nozzles 15 and 17 of the head portions 3C, 3M, 4Y and 4Bk at each level are exactly located on the corresponding lines, the following process is carried out.

In this process, the carriage 2 is moved in the scanning direction 57. During the movement of the carriage 2, ink droplets are ejected from the large-diameter nozzle 171*c* and 171*y* located on the downstream side with respect to the direction 58, so that the ink droplet ejected from the nozzle 171*c* deposits on the position where the ink droplet from the nozzle 171*y* has deposited on the recording medium.

Figure 5A:
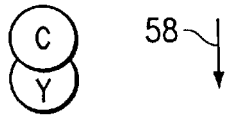
FIG. 5A is an enlarged plan view of two ink dots deposited on the recording medium in which a cyan dot is shifted upward from a yellow dot with respect to the second direction.
Figure 5B:
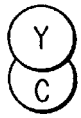
FIG. 5B is an enlarged plan view, like FIG. 5A, of two ink dots deposited on the recording medium in which the cyan dot is shifted downward from the yellow dot with respect to the second direction.

After the deposition of the ink droplets, it is judged whether the ink droplets from the nozzles 171*c* and 171*y* have been deposited on the same position. If it is determined that the ink droplets from the nozzles 171*c* and 171*y* have been deposited on the same position, no further adjustment is required. If, on the other hand, the ink droplets from the nozzles 171*c* and 171*y* have been deposited in different positions with respect to the direction 58, as shown in FIGS. 5A and 5B, which may occur when the support plate 5 is shifted from the predetermined position, the position of the support plate 5 is adjusted.

Figure 6:
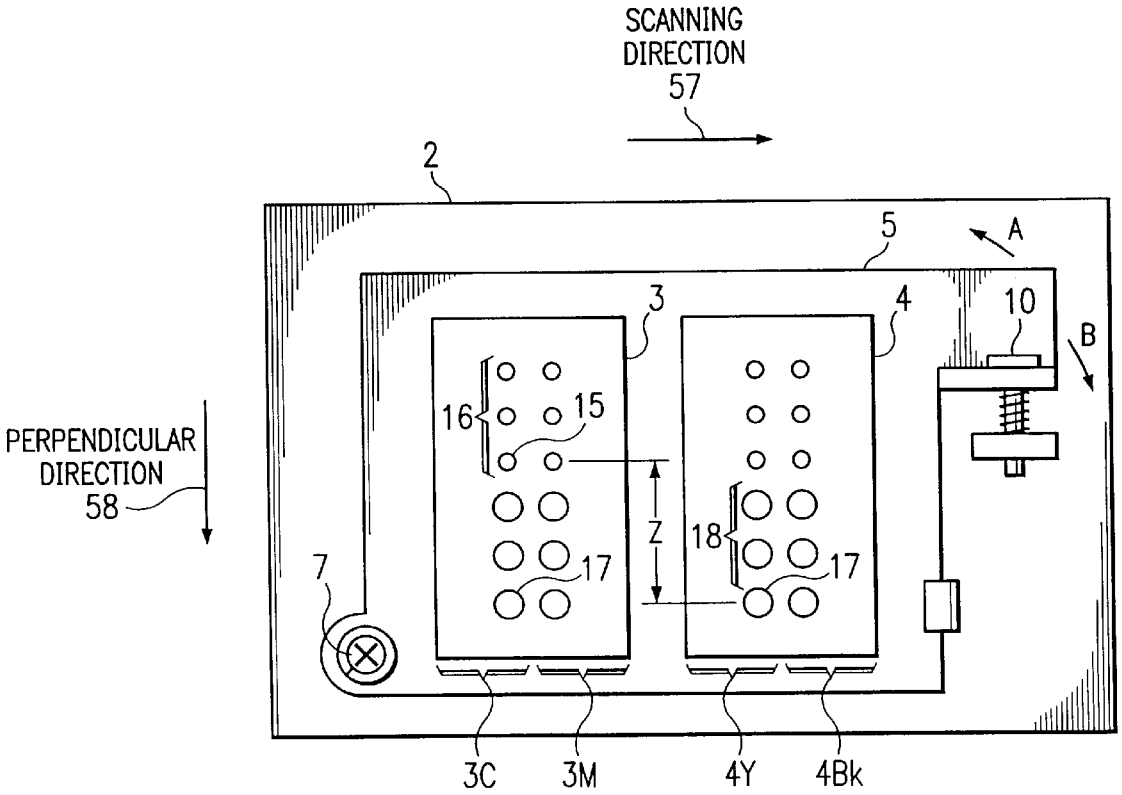
FIG. 6 is a front view of the ink-jet recording head having a support plate for use in an adjustment of the heads to correct the displacement of the deposited position of the ink droplets on the recording medium.

If the cyan dot is shifted upward (opposite to the direction 58,) from the yellow dot, the screw 7 is loosed and then the adjust screw 10 is rotated in the counterclockwise direction to slightly rotate the support plate 5 in the direction indicated at A in FIG. 6 so that the ink droplets from the nozzles 171*c* and 171*y* will deposit on the same position. If, on the other hand, the cyan dot formed by the deposition of the cyan ink droplet is shifted (in the direction 58), from the yellow dot formed by the deposition of the yellow ink droplet, after loosing the screw 7, the adjust screw 10 is rotated in the clockwise direction to slightly rotate the support plate 5 in the direction indicated at B in FIG. 6 so that the ink droplets from the nozzles 171*c* and 171*y* will be deposited on the same position. Finally, the screw 7 is tightened to fix the support plate 5, which allow the printer 100 to perform the color printing.

As described above, according to the ink-jet printer 100, the position of the support plate 5 bearing the print heads 3 and 4 can be adjusted on the carriage 2 simply by rotating the adjust screw 10, allowing the support plate 5 to be initially positioned roughly and thereby facilitating its assembling.

Also, the adjust mechanism can correct the displacement of the ink deposition on the recording medium which may occur if the carriage would tilt in its scanning because of the wearing of the contact portions of the carriage and/or the shaft supporting the same. Thus, the ink-jet recording head of the invention allows the displacement of the ink dot position from the aimed position to be readily corrected, ensuring the reproduction of high quality image.

Although, in the ink-jet printer 100 described above, the head portions 3C and 3M are provided in the print head 3 and the head portions 4Y and 4Bk are provided in the print head 4, these four head portions 3C, 3M, 4Y and 4Bk may be secured in one print head, or they may be mounted individually. In the case that one print head includes four head portions, although each nozzle can be exactly arranged in positions on the print head, a positional error in attaching the print head to a support member such as carriage and a positional displacement of ink dots caused in an actual use can occur. Also, the description has been made to the ink-jet printer for color printing, however, the present invention can also be applied to an ink-jet printer for mono-color printing.

Although the adjust mechanism which is constructed by adjust screw 10, spring 11 and the like is preferably provided at a right or left side of the print heads 3 and 4 in FIG. 6 for space saving of the printer, it may be provided above or below the print heads 3 and 4.

Figure 7:
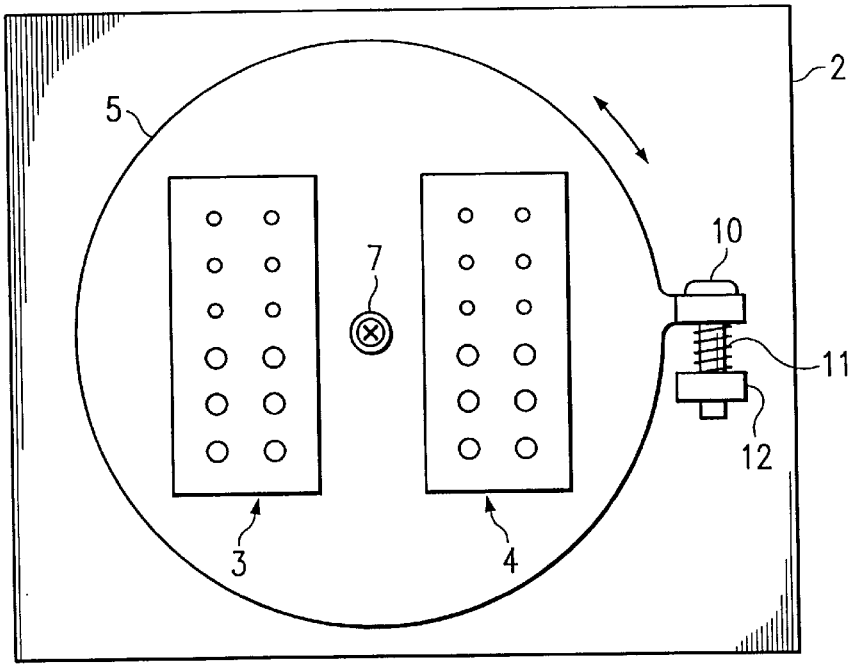
FIG. 7 is a front view of a modified ink-jet recording head.

Further, although the rectangular support plate 5 to which the print heads 3 and 4 are fixed is designed to rotate about the pivot 7 located at one end portion of the support plate 5 in this embodiment, the invention is not limited thereto. For example, as shown in FIG. 7, when using a support plate 5 in the form of disk, preferably the support plate 5 is rotatably supported at its center about a pivot 7 and thereby a relative position of the support plate 5 with respect to the carriage 2 may not change even when positions of nozzles of the print heads 3 and 4 are adjusted by rotating the support plate 5 about the pivot 7.

Figure 8:
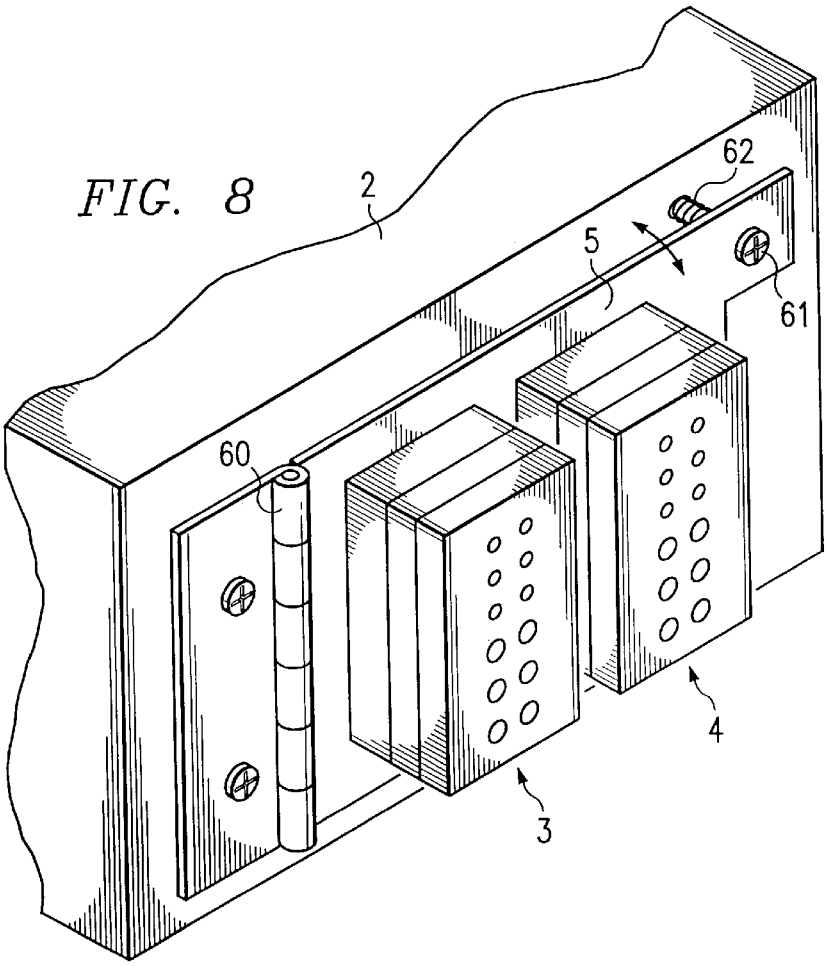
FIG. 8 is a perspective view of an another modified ink-jet recording head.

Although, in the above-described embodiment, the positions of the nozzles are adjusted in a plane parallel to the recording medium, the invention is not limited thereto, the support plate may be designed to tilt in a vertical direction from the carriage as shown in FIG. 8. In this arrangement, a hinge 60 is provided at one end portion of a support plate 5 and a adjust screw 61 is provided at the opposite end portion thereof so that the support plate 5 is capable of rotating about the hinge 60 to and from the carriage 2. A spring 62 is mounted around the adjust screw 61 for biasing the support plate 5 away from the carriage 25. Thus, the support plate 5 can be moved to and from the carriage 2 by rotating the adjust screw 61 in opposite directions.

In view of above, positions of the nozzles can be adjusted with respect to a direction towards the recording medium from the heads to adjust angles at which ink droplets propel to the recording medium, distances from the heads to the recording medium and the like, and ensuring the ink droplets to be deposited on the recording medium in a suitable condition.

Next, an operation for reproducing colors by superimposing large and small ink droplets will be described hereinafter.

In multi-color printing by the ink-jet printer 100, a color reproduction is performed by superimposing large and small ink dots having different colors on the recording medium with the movement of the carriage 2 in the scanning direction 57. For example, when a cyan small ink dot is superimposed on a yellow large ink dot on the recording medium, first, the yellow large ink droplet is ejected from the large-diameter nozzles 17 (see FIG. 6) of the large-diameter nozzle array 18 of the head portion 4Y, thereby forming a yellow ink dot on the recording medium.

Subsequently, when the small-diameter nozzles 15 (see FIG. 6) of the small-diameter nozzle array 16 of the head portion 3C have just arrived at positions corresponding to the yellow ink dots previously formed on the recording medium, cyan small ink droplets are ejected from the small-diameter nozzles 15 to deposit on the yellow ink dots. A time difference between the depositions of yellow and cyan ink droplets on the recording medium is approximately equal to a time in which the recording medium moves in the direction 58 by a distance Z (see FIG. 6) between the large-diameter nozzle 17 and the small-diameter nozzle 15.

The time difference is greater than a period of time in which the yellow ink droplets deposited previously can be absorbed in the recording medium and then dried. This ensures that the two ink materials are not mixed, preventing a mixture of colors. Also, since the cyan small ink dot is superimposed on the yellow large ink dot so that the yellow ink dot is not fully covered by the cyan ink dot, the colors of two ink dots are kept, respectively. As a result, a high quality colorful image can be reproduced.

Besides, even when a color reproduction is performed by the combination of large and small ink droplets having different colors without being superimposed, the like effect described above can be obtained. For example, when the cyan small ink droplet is deposited immediately adjacent to the yellow large ink droplet deposited previously on the recording medium before the yellow ink droplet will be dried, it may cause a mixture of colors by the possible contact of the cyan ink material with the yellow ink material on the recording medium.

To prevent this, according to the ink-jet printer 100 of the invention, since the small ink droplet is deposited adjacent to the large ink droplet only after the large ink droplet has dried, ink dots of the ink materials can be formed on the recording medium independently. As a result, a high quality colorful image can be reproduced.

Further, by using a technique in which the large ink droplet deposited previously on the recording medium is dried and then the small ink droplet having the same color as the large ink droplet is superimposed on the large ink droplet, an ink dot made of two portions having the same color but different density can be formed. In this case, however, if the second ink droplet is superimposed on the first ink dot before the first ink dot deposited previously on the recording medium has dried, two ink materials will be mixed, which results in an ink dot having no color variation. According to the recording heads of the invention, the second ink droplet is superimposed on the first ink dot only after the first ink dot has fully dried, and therefore an ink dot having two portions of the same color but different densities can be formed, increasing a gradation of color. Also, the invention can overcome the problem that the two undried ink dots mix each other to degrade the configuration or contour of the composite color dot.

In the head portions 3C, 3M, 4Y and 4Bk, the large-diameter nozzle array 18 is arranged on the downstream side of the small-diameter nozzle array 16 with respect to the direction 58 so that large ink droplets are firstly deposited on the recording medium prior to the deposition of small ink droplets, however, when, for example, using a quick drying ink material, the small-diameter nozzle array 16 may be arranged on a downstream side of the large-diameter nozzle array 18 with respect to the direction 58 so that the small ink droplets may be deposited on the recording medium prior to the deposition of the large ink droplets. In this case, since the small ink dot will fully dry before the large ink droplet will be superimposed on the small ink dot, the large ink droplet is absorbed in the recording medium without being mixed with the first deposited ink material, and therefore a high quality colorful image can be reproduced.

Although, in the print heads of the invention, different sizes of nozzles are provided for ejecting large and small ink droplets, sizes of the ink droplets to be ejected may be changed in other ways. For example, the ink channels 22 and/or the piezoelectric members 25 for ejecting large ink droplets may be larger than those for ejecting small ink droplets with each nozzle having the same size in diameter. Also, by varying physical properties, such as viscosity and surface tension, of ink materials having a same color, the size of the ink droplet ejected through the nozzle can be changed even when the same pressure is applied to ink materials in the ink channels 22. Therefore, a physical property of an ink material received in the ink channels 22 for ejecting large ink droplets may be different from that of an ink material received in the ink channels 22 for ejecting small ink droplets.

Besides, the invention can be effectively applied to a printer having one head for reproducing a mono-color halftone image. Further, when using two types of ink materials, oily and aqueous ink materials, and depositing them at the same position on the recording medium, a mixing of colors of the ink materials is effectively prevented.

Although the pressurizing members made of the piezoelectric material are used in this embodiment, it is not limited thereto, and another means capable of activating an ink material can be employed. For example, an ink material may be pressurized by a bubble generated in the ink channel with a heating element.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included herein.

What is claimed is:

1. An ink-jet printer having a print head which moves in a first direction as it ejects ink droplets through a plurality of nozzles onto a recording medium to reproduce an image on said recording medium, comprising:

a first nozzle group which includes a plurality of first nozzles arranged in a second direction which is perpendicular to said first direction; and a second nozzle group which includes a plurality of second nozzles arranged along said second direction, said second nozzles ejecting ink droplets having a size larger than a size of ink droplets ejected from said first nozzles;

wherein the nozzles of said first and second nozzle groups are arranged substantially along a single, common line that extends along said second direction, wherein a physical property of an ink material comprising ink droplets ejected from said second nozzles is different than said physical property of an ink material comprising ink droplets ejected from said first nozzles, ink materials ejected from said first and second nozzles being substantially the same color, said physical property of the ink materials elected from said first and second nozzles being selected from the group consisting of viscosity and surface tension.

2. An ink-jet printer in accordance with claim 1, further comprising a carriage for holding said first and second nozzle groups and for moving said first and second nozzle groups according to a recording motion.

3. An ink-jet printer in accordance with claim 2, further comprising an adjusting mechanism on said carriage for holding said first and second nozzle groups and for permitting an adjustment of a position of said first and second nozzle groups in said second direction.

4. An ink-jet printer in accordance with claim 1, wherein each nozzle of said first nozzle group has a size different from that of each nozzle of said second nozzle group.

5. An ink-jet printer in accordance with claim 1, wherein said plurality of first nozzles of said first nozzle group and said plurality of second nozzles of said second nozzle group are arranged adjacent to each other and wherein said first nozzles are grouped adjacent to each other and said second nozzles are grouped adjacent to each other.

6. An ink-jet printer in accordance with claim 1, wherein a size of each of said second nozzles is larger than a size of each of said first nozzles.

7. A print head for use in an ink-jet printer, comprising:

a first nozzle group which includes a plurality of first nozzles for ejecting first ink droplets; and a second nozzle group which includes a plurality of second nozzles for ejecting second ink droplets, said second ink droplets being larger than said first ink droplets;

wherein said plurality of first nozzles of said first nozzle group and said plurality of second nozzles of said second nozzle group are arranged substantially along a single, common line, said first nozzles being grouped thereon adjacent to each other, and wherein said first and second nozzle groups are arranged adjacent to each other; and wherein a physical property of an ink material comprising ink droplets ejected from said second nozzles is different than said physical property of an ink material comprising ink droplets ejected from said first nozzles, the ink materials ejected from said first and second nozzles being substantially the same color, said physical property of the ink materials ejected from said first and second nozzles being selected from the group consisting of viscosity and surface tension.

8. An print head in accordance with claim 7, wherein a size of said second nozzles is larger than a size of said first nozzles.

9. An ink-jet printer having a print head which moves in a first direction as it ejects ink droplets through a plurality of nozzles onto a recording medium to reproduce an image on said recording medium, comprising:

a first nozzle group which includes a plurality of first nozzles arranged in a second direction which is perpendicular to said first direction;

a second nozzle group which includes a plurality of second nozzles arranged along said second direction, said second nozzles ejecting ink droplets having a size larger than a size of ink droplets ejected from said first nozzles;

wherein said nozzles of said first and second nozzle groups are arranged substantially along a single, common line that extends along said second direction, said plurality of first nozzles of said first nozzle group and said plurality of second nozzles of said second nozzle group being arranged adjacent to each other with said first nozzles being grouped adjacent to each other and said second nozzles being grouped adjacent to each other; and a device for moving said recording medium in said second direction relative to said print head so that as said recording sheet is moved in said second direction, an ink droplet can be ejected from a nozzle of said second nozzle group and an ink droplet can be ejected from a nozzle of said first nozzle group in sequence such that the sequentially ejected ink droplets are deposited onto said recording medium in substantially identical positions to form superimposed ink droplets, wherein a physical property of an ink material comprising said ink droplet ejected from a nozzle of said second nozzles is different than said physical property of an ink material comprising said ink droplet ejected from a nozzle of said first nozzles, the ink materials ejected from said first and second nozzles being substantially the same color, said physical property of the ink materials ejected from said first and second nozzles being selected from the group consisting of viscosity and surface tension.

10. An ink-jet printer having a print head which moves in a first direction as it ejects ink droplets through a plurality of nozzles onto a recording medium to reproduce an image on said recording medium, comprising:

a first nozzle group which includes a plurality of first nozzles arranged in a second direction which is perpendicular to said first direction;

a second nozzle group which includes a plurality of second nozzles arranged along said second direction, said second nozzles ejecting ink droplets having a size larger than a size of ink droplets ejected from said first nozzles;

wherein the nozzles of said first and second nozzle groups are arranged substantially along a single, common line that extends along said second direction;

said plurality of first nozzles of said first nozzle group and said plurality of second nozzles of said second nozzle group being arranged adjacent to each other with said first nozzles being grouped adjacent to each other and said second nozzles being grouped adjacent to each other;

a device for moving said recording medium in said second direction relative to said print head;

wherein said first nozzle group has an identical number of nozzles as said second nozzle group, a spacing between each of said first nozzles being substantially identical to a spacing between each of said second nozzles; and wherein when said print head is moved in said first direction at least two times said device for moving said recording medium moves said recording medium between movements of said print head at said at least two times such that as said print head moves in said first direction for a first time ink droplets can be ejected from nozzles of said second nozzle group, and as said print head moves in said first direction for a second time ink droplets can be ejected from nozzles of said first nozzle group, so that each ink droplet ejected from a first nozzle is deposited onto said recording medium in a substantially identical position as a respective one of said ink droplets ejected from said second nozzles so that a plurality of superimposed ink droplets are thereby formed, wherein a physical property of an ink material comprising said ink droplets ejected from said second nozzles is different than said physical property of an ink material comprising said ink droplets ejected from said first nozzles, the ink materials ejected from said first and second nozzles being substantially the same color, said physical property of the ink materials ejected from said first and second nozzles being selected from the group consisting of viscosity and surface tension.

11. An ink-jet printer having a print head which moves in a first direction as it ejects ink droplets through a plurality of nozzles onto a recording medium to reproduce an image on said recording medium, comprising:

a first nozzle group which includes a plurality of first nozzles arranged in a second direction which is perpendicular to said first direction;

a second nozzle group which includes a plurality of second nozzles arranged along said second direction, said second nozzles ejecting ink droplets having a size larger than a size of ink droplets ejected from said first nozzles;

wherein said nozzles of said first and second nozzle groups are arranged substantially along a single, common line that extends along said second direction;

said plurality of first nozzles of said first nozzle group and said plurality of second nozzles of said second nozzle group being arranged adjacent to each other with said first nozzles being grouped adjacent to each other and said second nozzles being grouped adjacent to each other; and a speed of movement of said recording medium in said second direction relative to said print head is set based on an ink characteristic so that for sequentially ejected ink droplets, a first ink droplet of said sequentially ejected ink droplets is deposited onto said recording medium and fully dries prior to a second ink droplet of said sequentially ejected ink droplets being ejected, wherein a physical property of an ink material comprising ink droplets ejected from said second nozzles is different than said physical property of an ink material comprising ink droplets elected from said first nozzles, the ink materials ejected from said first and second nozzles being substantially the same color, said physical property of the ink materials ejected from said first and second nozzles being selected from the group consisting of viscosity and surface tension.

* * * * *